US008316486B2

(12) United States Patent
Tipperreiter

(10) Patent No.: US 8,316,486 B2
(45) Date of Patent: Nov. 27, 2012

(54) SUPPORT FRAME FOR ELEVATING A BED COVERING

(75) Inventor: Mark Tipperreiter, Portland, OR (US)

(73) Assignee: Mark R. Tipperreiter, Portland, OR (US)

( * ) Notice: Subject to any disclaimer, the term of this patent is extended or adjusted under 35 U.S.C. 154(b) by 123 days.

(21) Appl. No.: 12/825,458

(22) Filed: Jun. 29, 2010

(65) Prior Publication Data

US 2011/0314606 A1 Dec. 29, 2011

(51) Int. Cl.
*A47C 21/02* (2006.01)

(52) U.S. Cl. ..... 5/505.1; 5/658; 5/504.1; 5/503.1

(58) Field of Classification Search ..... 5/505.1, 5/504.1, 658; 74/841; 248/200
See application file for complete search history.

(56) References Cited

U.S. PATENT DOCUMENTS

| | | | | |
|---|---|---|---|---|
| 2,602,171 | A | 7/1952 | Good | |
| 2,618,789 | A | 11/1952 | Kane | |
| 2,642,589 | A | 6/1953 | Cobb | |
| 4,570,275 | A | 2/1986 | Merriman | |
| 4,802,252 | A | 2/1989 | Marmor | |
| 4,841,589 | A | 6/1989 | Moore | |
| 4,937,903 | A | 7/1990 | Joly et al. | |
| 4,975,997 | A | 12/1990 | Misiura et al. | |
| 5,329,658 | A | 7/1994 | Fontenot et al. | |
| D352,847 | S | 11/1994 | Station | |
| D372,822 | S * | 8/1996 | O'Brien | D6/503 |
| 5,881,406 | A | 3/1999 | Cobb | |
| 6,163,901 | A | 12/2000 | Sergent | |
| 6,240,581 | B1 | 6/2001 | Pender | |
| 6,834,403 | B1 | 12/2004 | Elliott | |
| 6,895,615 | B2 * | 5/2005 | Dilascio | 5/505.1 |
| 6,901,616 | B1 | 6/2005 | Warromgtpm et al. | |
| 7,137,159 | B1 | 11/2006 | Choate | |
| 2003/0229942 | A1 * | 12/2003 | Dilascio | 5/505.1 |
| 2005/0044630 | A1 * | 3/2005 | Danaher | 5/414 |
| 2005/0273931 | A1 * | 12/2005 | Edwards | 5/505.1 |
| 2008/0006317 | A1 * | 1/2008 | Livacich et al. | 135/123 |
| 2008/0203804 | A1 * | 8/2008 | Park et al. | 297/451.2 |
| 2008/0295247 | A1 * | 12/2008 | Rogers | 5/505.1 |
| 2009/0235455 | A1 * | 9/2009 | Strickland | 5/505.1 |

* cited by examiner

*Primary Examiner* — Robert G Santos
*Assistant Examiner* — Brittany Wilson
(74) *Attorney, Agent, or Firm* — Peter A. Haas Esquire LLC

(57) ABSTRACT

A plurality of hollow tubular frame members interconnected by a single internal elastic retaining member that ensures each frame member aligns relative to each remaining frame member in a manner that only one arrangement of frame members is possible when assembled. To assemble, the frame members interconnect forming a three-dimensional frame suitable for supporting a bed cover. The frame members are held in tension by the internal retaining member. The frame members interlock via an insert device between adjacent frame members. The entire assembly interlocks and selectively decouples for disassembly. When disassembled, the entire assembly lies relatively flat, which enables a compact design suitable for packaging, transport or storage.

1 Claim, 6 Drawing Sheets

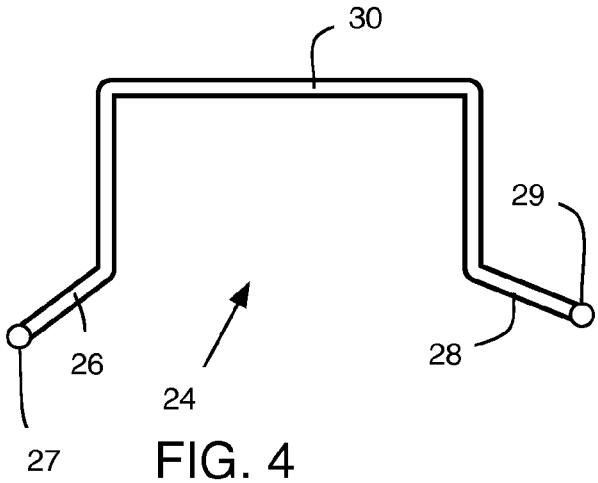
FIG. 4
FIG. 5
FIG. 6
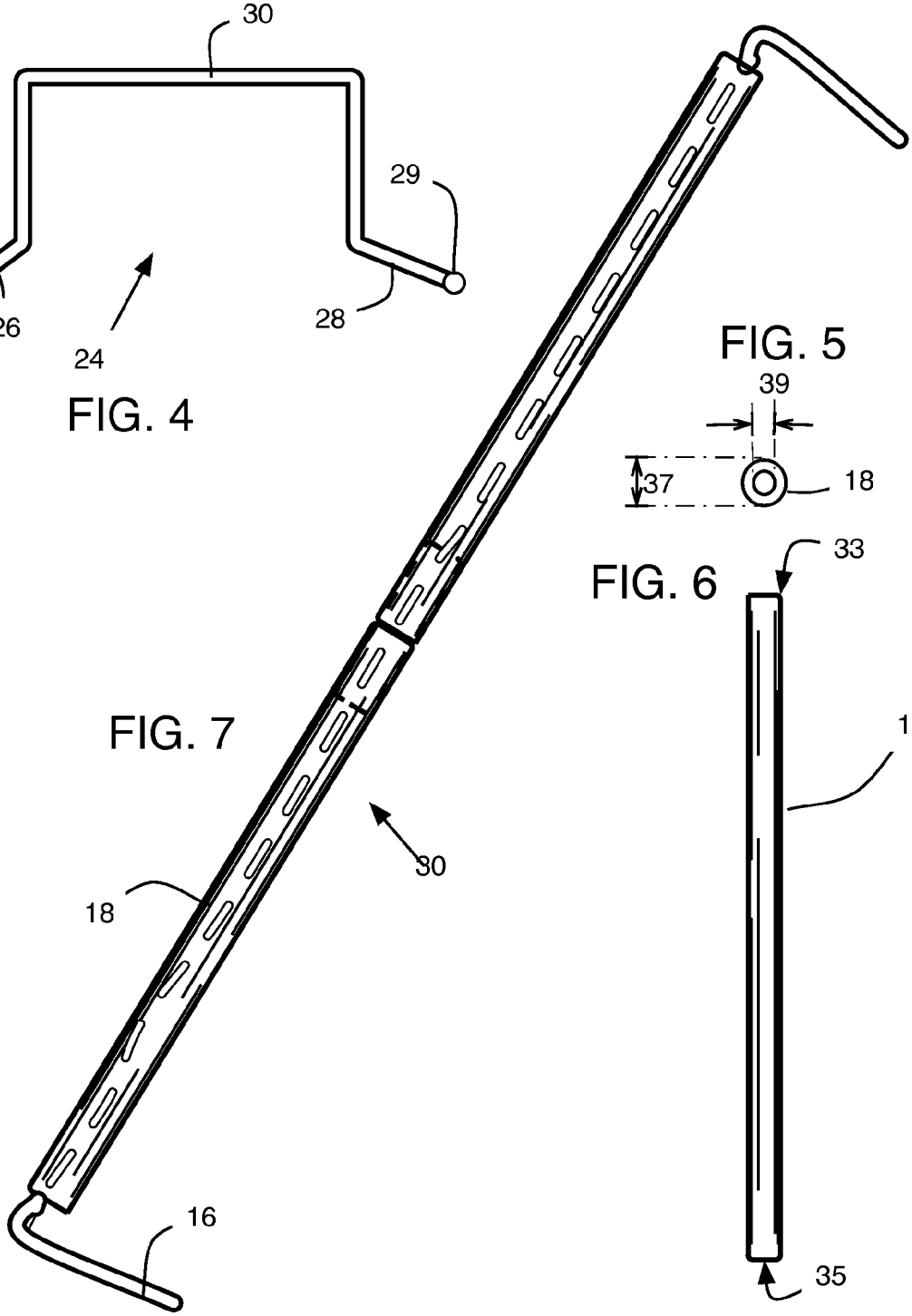
FIG. 7

SUPPORT FRAME FOR ELEVATING A BED COVERING

BACKGROUND

1. Field of the Invention

The present invention relates generally to bedding support devices and, more particularly, to a device for elevating a blanket or bed covering away from the feet of a bed occupant.

2. Description of the Related Art

There are many reasons why a bed occupant may desire a device that elevates bed covers from resting against his or her feet. For some, the weight of the bedding aggravates suffering due to common foot ailments. Burn victims, for example, cannot have even the lightest of coverings touching their skin without extreme pain. And yet, for others—those that share their bed with their beloved domesticated pet such as a dog or cat—there is a desire to provide ample air space and room for the pet to burrow comfortably yet maintain the cover over the lower extremity of the human user.

In fact, there are ample attempts to provide a device for elevating covers from an occupant's feet. One exemplary device, described in U.S. Pat. No. 6,834,403 issued to Elliot on 28 Dec. 2004, discloses a tubular frame member adapted to insert between a top mattress and box spring common to modern beds. Elliot teaches a rigid, non-folding frame having a width of the substantially less than the width of the mattress and must be inserted under the end of the mattress and its use is limited to one occupant of the bed. The rigid frame does not collapse into a compact shape suitable for shipping, transportation or storage and moreover, the Elliot device does not self-assemble from a collapsed position using an internal elastic member.

Another attempt to provide an improved support device for bedding includes the "Bedclothes Support Assembly" of Choate disclosed in U.S. Pat. No. 7,137,159 issued on 21 Nov. 2006. Therein a series of tubular segments coupled by rounded elbows link together to form a frame having a pair of vertical arms supporting a horizontal member and a C-shaped base. One shortcoming of the Choate device is a lack of self-assembly means and an overly cumbersome base portion to provide sufficient stability for the upper horizontal member. It would be beneficial to have a simpler design with fewer components and arranging the components in a manner with means for self-assembly.

A simpler approach, a "Blanket Support Assembly" by Warrington et al. disclosed in U.S. Pat. No. 6,901,616 includes two vertical arms connecting a single horizontal member. However the arms require a support mechanism that is anchored to the bed frame. When not in use, Warrington teaches rotating the horizontal member and linking arms to the foot of the bed. This approach does not dis-assemble when not in use, does not fold to a compact size for storage or shipping, and must be coupled to a bed frame for structural rigidity. Therefore, it would be beneficial to have an improved structure that could be taken apart for storage and shipping and further, not require mechanical coupling to a bed frame for the required rigidity.

Yet another representative cover support for a bed includes the disclosure of Dilascio in U.S. Pat. No. 6,895,615 issued on 24 May 2005. Dilascio discloses a segmented horizontal arm coupled to a pair of vertical uprights, each upright inserting into a sleeve, the sleeve mounted to an inverted U-shaped plate and a flat, elongated member connecting the two inverted u-shaped plates. This design, does not self-assembly and requires the mattress weight to retain its upright stance. Therefore, it would be beneficial for an improved structure to be self-standing.

Despite attempts in the art to provide a frame suited for supporting covers while installed over a mattress, there remains yet a need for an improved cover-supporting frame that not only adapts for use for a myriad of bed widths and heights and for different sized users but also is easy and economical to manufacture, be assembled in such a way to enable a tool-free and an error-free means of assembly by the end user yet collapse to varying compact sizes when not in use. It would be desirable to have a self-assembling frame support that is both light-weight yet rigid.

SUMMARY OF THE INVENTION

The present invention contemplates a device suited for supporting bed covers in a manner that prevents them from contacting a bed-user's feet. The device consists of a frame that overcomes the limitations and solves problems not contemplated in the prior art. Advantages to the various embodiments of the present invention include:

- A plurality of straight segments, each of which is free to rotate 360 degrees around its longitudinal axis;
- A first and fourth corner segment that are each free to rotate 360 degrees relative to a vertical axis (the vertical axis corresponding to the long axis of the second and sixth straight segments);
- Each straight segment is the same length and o.d. and i.d. for Queen-sized beds (King, twin and full-sized models may have straight segments of varying lengths to span varying mattress widths);
- Each rounded segment is of the same length, o.d., i.d. and radius;
- Each insert is the same size;
- The entire frame can be folded downward to be flush with the surface of the top mattress when not in use to maintain the aesthetic appeal of a traditionally-made bed and can also be fully collapsed into a flat, compact shape suitable for storage, shipping and travel. In every case each component remains in the same relative position through the use of a unique elastic member which ensures error-free assembly by the user.
- When in the fully-assembled position, the frame is self-supporting;
- Additional rigidity is gained by the pressure of the weight of the mattress on the horizontal legs of the assembly, yet the presence of the feet under the mattress is undetectable by the user; and
- the light-weight components when assembled present a strong and rigid structure.

The frame is produced as a single assembly, which requires no tools and only the most basic of installation instructions.

The frame can be positioned along any part of the length of the mattress to accommodate users of varying heights and sleeping positions.

The use of the frame removes the weight and pressure of bedcovers from the feet of the user, alleviating discomfort caused by said weight and pressure while promoting improved blood circulation in toes and feet.

The use of the frame prevents bedding from sliding off the end of the bed during normal sleeping activities.

These advantages and others will be more appreciated by those skilled in the art in relation to the drawings and detailed description of the preferred embodiments described herein.

DRAWING

FIG. 4 is a front view of the embodiment of FIG. 3.

FIG. 5 is an end view of the component of FIG. 6.

FIG. 6 is a side view of a component of the present invention.

FIG. 7 is a side view of the component of FIG. 6 assembled with other components of the present invention.

DESCRIPTION OF THE INVENTION

Possible preferred embodiments will now be described with reference to the drawings and those skilled in the art will understand that alternative configurations and combinations of components may be substituted without subtracting from the invention. Also, in some figures certain components are omitted to more clearly illustrate the invention.

Figure 1:
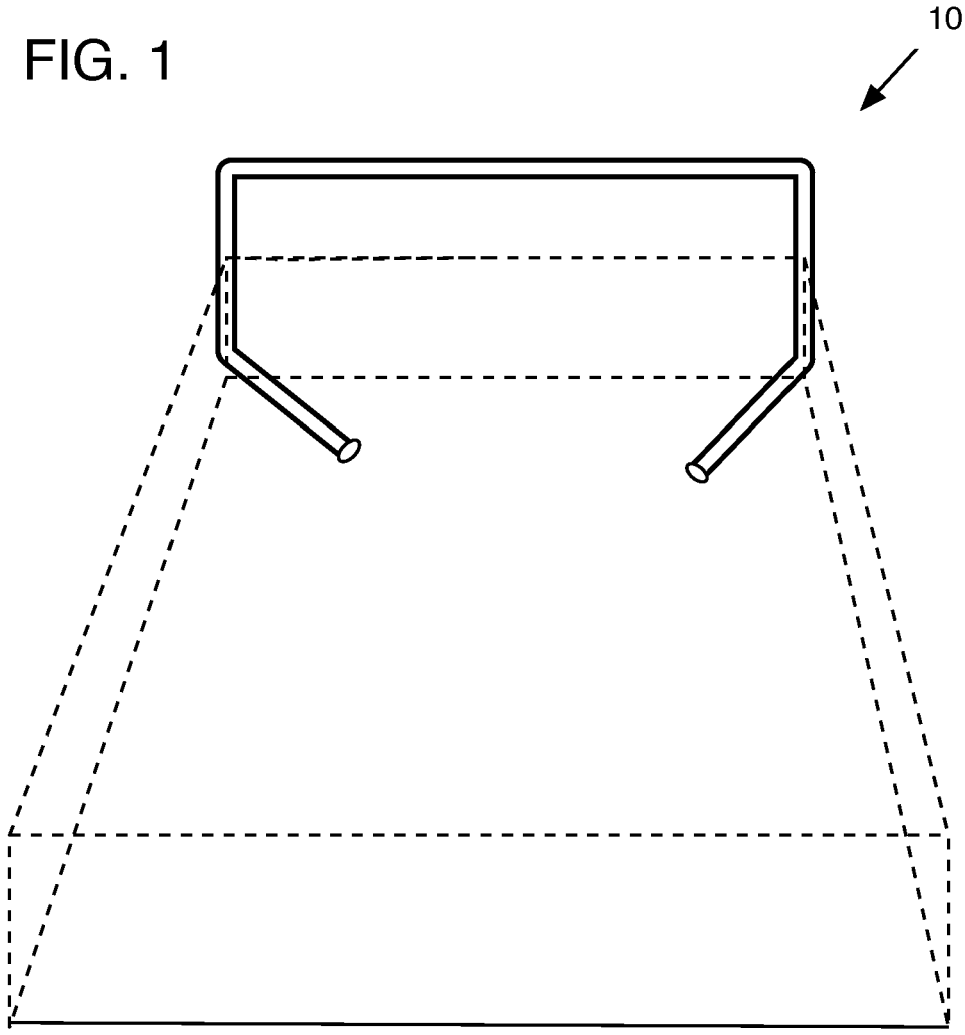
FIG. 1 is a front view of a preferred embodiment of the present invention in a suggested environment of use.
Figure 2:
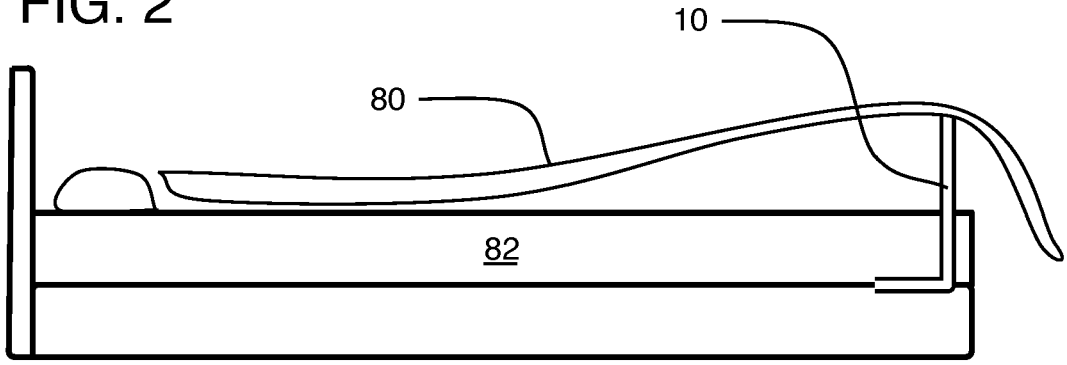
FIG. 2 is a side view of the embodiment of FIG. 1.

FIGS. 1 and 2 illustrate an environment of use for a preferred embodiment of the present invention consisting of a frame system 10 well-suited for use as a blanket 80 (or comforter, or duvet, or bedspread, or cover, and the like) support device. A portion of the device 10 consisting of a first L-shaped leg and a second L-shaped leg inserts under a mattress 82 (or box-spring, or futon, and the like), each leg in turn provides a horizontal foot for securing between a mattress and box-spring, or a mattress and bed frame, and each leg further includes a vertical member connected to the foot at about a 90-degree angle, the foot can rotate about 360-degrees in a plane perpendicular to the longitudinal (or vertical) axis of the leg's vertical member. Each leg supports a corresponding end of a horizontal frame member that is adapted for use to support a cover. The horizontal frame member arranges approximately about 90-degrees relative to the vertical leg member. As FIG. 1 shows, a preferred alignment of the feet relative to the leg and horizontal support is about 45-degrees: This orientation provides a very stable and rigid support for the cover when draped over the frame device 10, as FIG. 2 illustrates.

Figure 3:
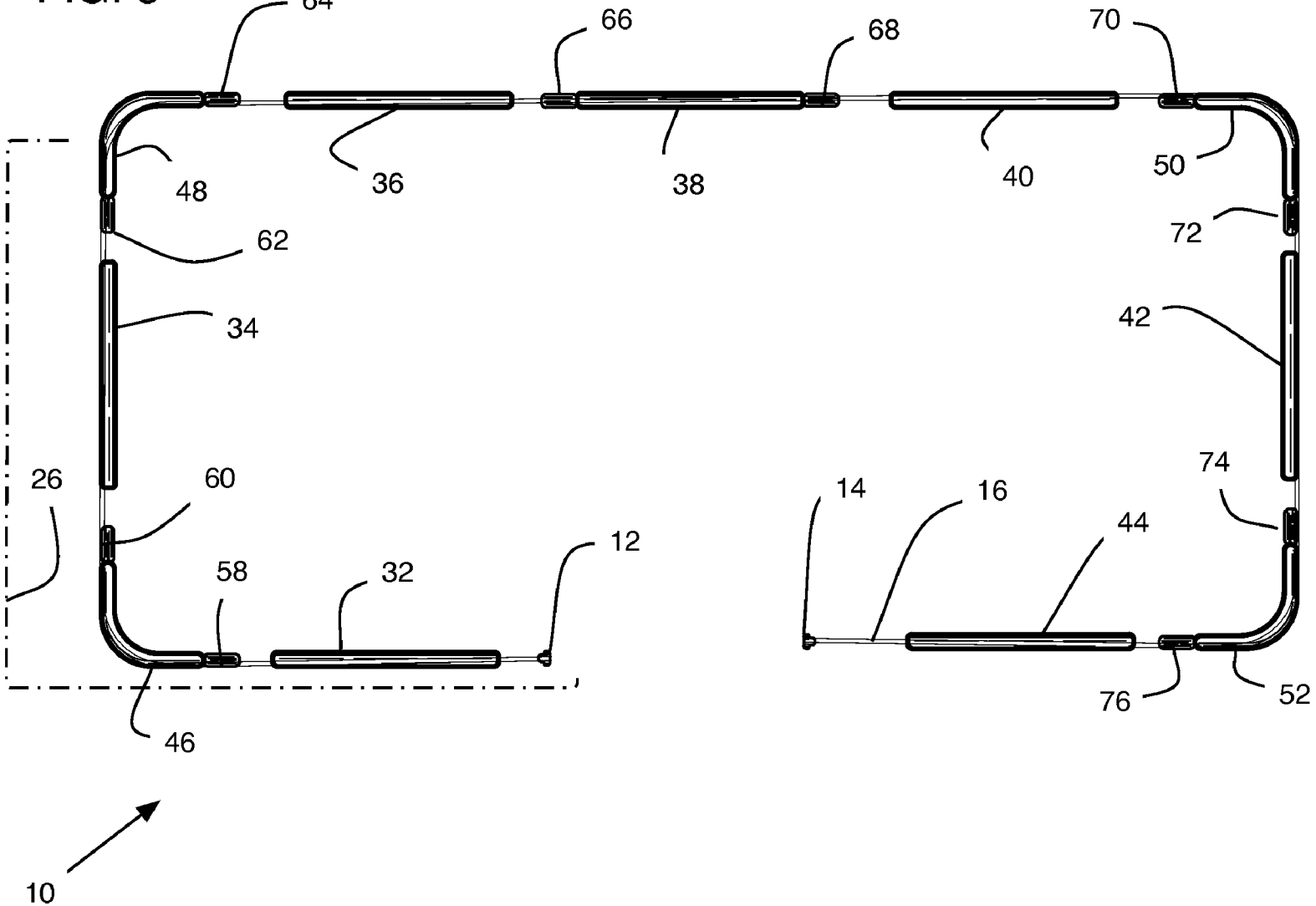
FIG. 3 is a top exploded assembly view of a device according to an alternative preferred embodiment of the present invention.

FIG. 3 illustrates an exploded or assembly view of the various components of the preferred embodiment of the present invention consisting of a componentized frame system 10 pre-assembled in a specific sequence so that an end-user can only assemble the components in one configuration, as will be discussed subsequently herein.

Making general reference to FIGS. 3-9, the system of the present invention is contemplated as a bedding-support device 10 comprising (as broadly depicted in FIG. 4) at least one frame member 24, or preferably a horizontal support frame 30 connected at each opposite end to a corresponding vertical leg frame 26 and 28. Each leg frame consists of a horizontal foot member and a vertical leg member. The frame member consists of at least one, and preferably a plurality of, tubular and hollow segments, such as the straight segment 18 of FIGS. 5 and 6 having an open first end 33, an open second end 35, at least one straight wall forming a tube having an outer diameter 37 and an inner diameter 39, the at least one wall defining a hollow interior portion adapted to receive an elastic cord member 16 (as FIG. 7 shows, for example).

In a preferred embodiment, as FIG. 3 shows, for example, the present invention consists of a frame made of a plurality of interconnecting components. The frame consists of at least one elastic member 16, and preferably only one elastic member 16 having a first end coupled to a first end cap 12 and an opposite, second end coupled to a second end cap 14. The elastic member, for example, for a support frame 10 for use with a standard American-sized queen bed would include an about 84-inch long to about 108-inch long elastic member, having an outer diameter of about ⅛-inch and comprised one or more elastic strands forming a core, covered in a woven sheath usually of nylon or cotton, available through multiple independent manufacturers. Of significance, the shock cord when inserted into each hollow member and attached at each end to the end caps should be of sufficient length to be in tension at all times, yet have enough elasticity to enable the user to separate the components for disassembly, as will be discussed further herein.

The elastic member 16 is tied to each respective end cap 12 14 using a knot and the end is fused using heat to prevent fraying or untying.

The single elastic member 16 is disposed inside each of the components, so when in the final assembly position (of FIG. 1, for example) the elastic member is completely hidden from view. Further, the elastic member must provide sufficient elasticity or yield to enable a user to pull apart adjacent components to selectively disassemble the device 10 when not in use as a blanket support frame (for storage, shipping, or to maintain the pleasing aesthetic of a traditionally-made bed, for example).

This preferred embodiment further includes at least one insert member coupled to one end of the frame member. The insert member consists of a hollow tube with open ends with an inner diameter sized to releasably couple to an adjacent segment (see FIG. 8, for example). One suitable dimensional relationship includes 0.490" outer frame member diameter, 0.438" inner frame member diameter and 0.433 outer frame member insert diameter The preferred embodiment of FIG. 3 includes at least one elastic cord member 16 coupled to a first end cap 12 at one end of the at least one frame system 10 and the cord passes through the interior portion of each component of the frame member, such as a first straight segment 32 and an interior portion of the at least one insert member, such as first insert member 58.

More specifically, the frame system 10 includes a plurality of serially arranged components consisting of a plurality of segments comprising a first straight segment 32, a first corner segment 46, a second straight segment 34, a second corner segment 48, a third straight segment 36, a fourth straight segment 38, a fifth straight segment 40, a third corner segment 50, a sixth straight segment 42, a fourth corner segment 52, and a seventh straight segment 44.

A corresponding insert member arranges intermediate to each segment: Accordingly, the embodiment of FIG. 3 includes a plurality of insert members arranged between and coupling adjacent segments, the plurality of inserts consists of a first insert member 58 arranged intermediate to the first straight segment and the first corner segment, in this embodiment the insert couples to the corner segment using an epoxy bond or press-fit together although other arrangements would work equally well including forming the insert member as an integral component of the corresponding segment.

But, as FIG. 3 shows, each corner segment is pre-assembled with an insert member at each end. As such, the plurality of insert member further includes a second insert member 60 arranged intermediate to the first corner 46 segment and the second straight segment 34, a third insert member 62 arranged intermediate to the second straight segment and second corner 48 segment; a fourth insert member 64 arranged intermediate to the second corner segment 48 and third straight segment 36; a fifth insert member 66 arranged intermediate to the third straight segment and fourth straight segment 38; a sixth insert member 68 arranged intermediate to the fourth straight segment and the fifth straight segment 40; a seventh insert member 70 arranged intermediate to the fifth straight segment and third corner segment 50; an eighth inset member 72 arranged intermediate to the third corner segment and the sixth straight segment 42; a ninth insert member 74 arranged intermediate to the sixth straight segment and fourth corner segment 52; and a tenth inset member 76 arranged intermediate to the fourth corner segment and the seventh straight segment 44.

Figure 8:
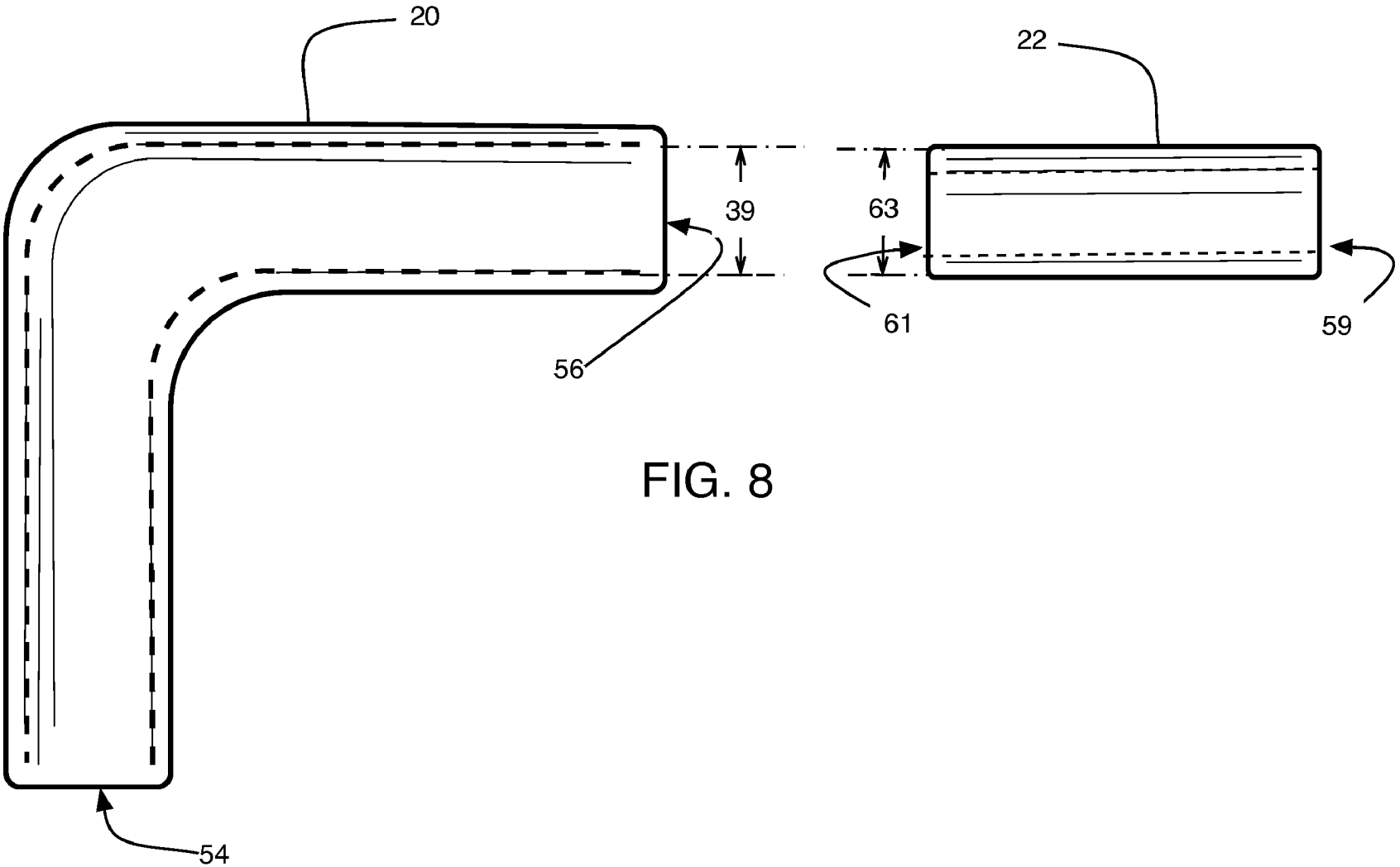
FIG. 8 is a top view of a corner segment and insert member according to a preferred embodiment of the present invention.
Figure 9:
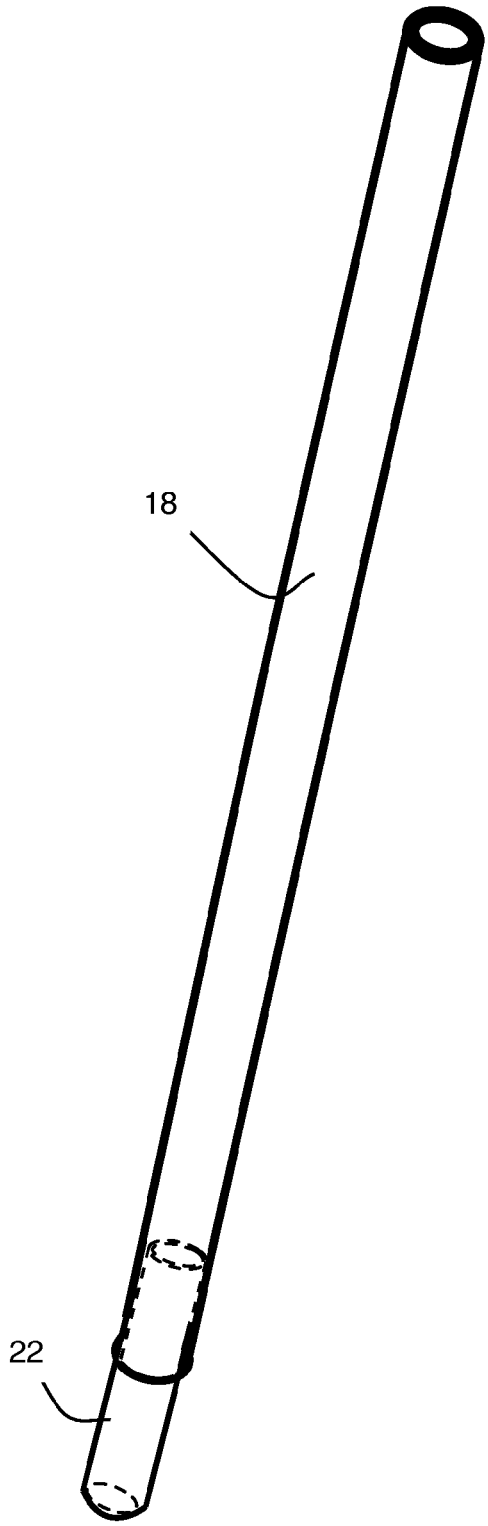
FIG. 9 is an off-set frontal view of the component of FIG. 6 assembled to an insert member.
Figure 10:
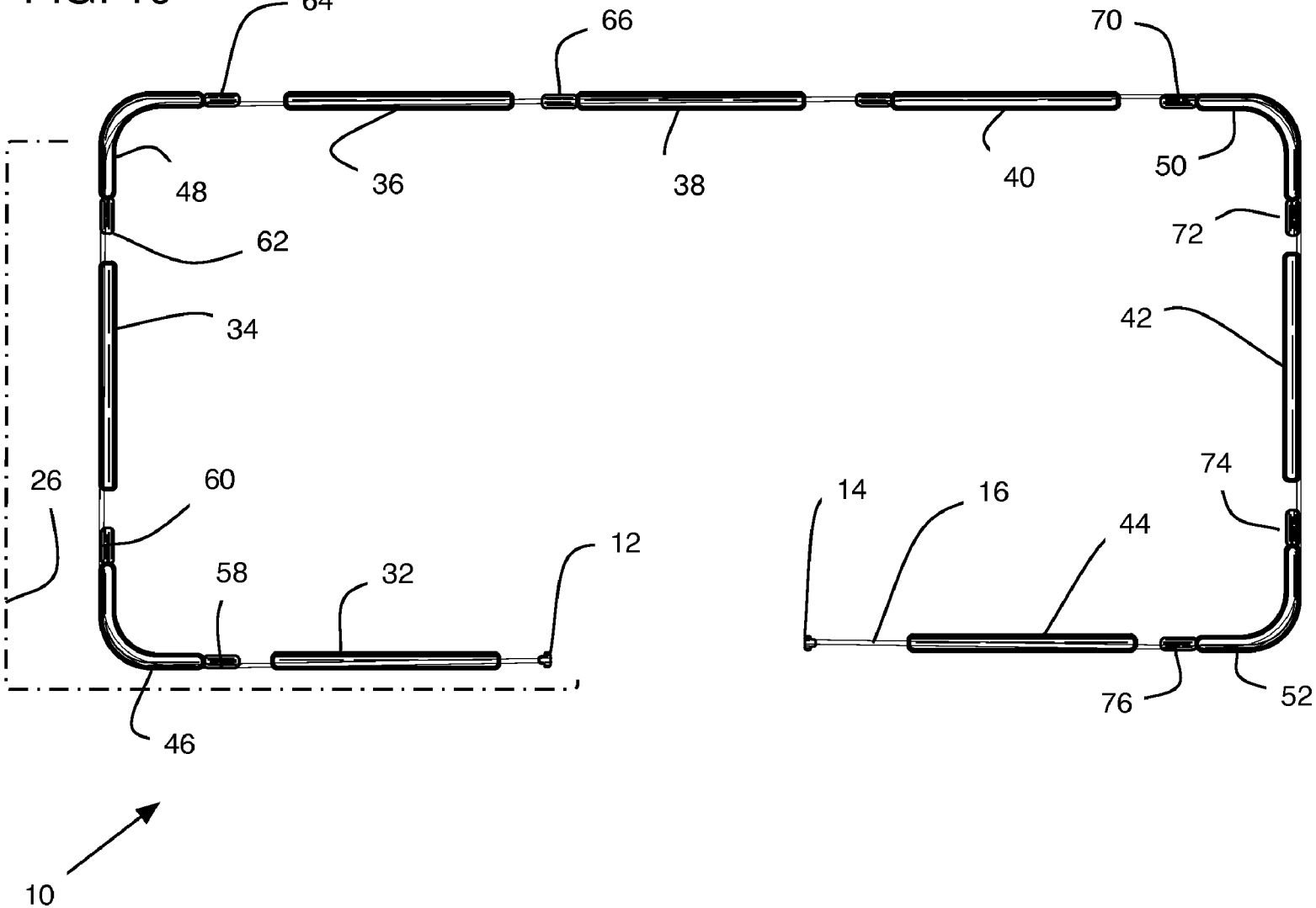
FIG. 10 is a top exploded assembly view of the embodiment of FIG. 1.

The various insert members of FIG. 3, for example, are of similar size and construction and can be represented by the insert 22 of FIGS. 8 and 9, for example. As such, one suitable dimensional relationship of the insert in a preferred embodiment consists of 4" long hollow tubing with an outer diameter of 0.433" and an inner diameter of 0.373" having an open first end 59 and open second end 61, the ends arranging opposite each other on a common longitudinal axis. The insert consists of at least one straight sidewall arranged to define a hollow interior portion and having a corresponding inner diameter and outer diameter. The outer diameter 63 is sized to snugly but slideably fit inside the inner diameter 39 of the adjacent segment (such as the segment 20 of FIG. 8).

In the preferred embodiment discussed herein, each of the straight segments consists of an aluminum tube having an outer diameter of about 0.490" and an inner diameter of about 0.438", forming a straight tube with hollow interior portion and open ends. The overall length of each of the straight members is about 18-inches. This dimension makes a good working size for standard height queen bed mattress and box spring, and the common size of each straight segment reduces manufacturing costs, however, in the spirit and scope of the invention it is contemplated that segments may be of differing sizes from each other and may vary in diameter or material and, therefore, could be tailored to a specific situation. For example, a futon on a frame may not require the same assembled height of the discussed embodiment, material selection for the segments may dictate a more optimal diameter to maximize strength, minimize cost, etc. Similarly, the corner segments are formed 5" long on each side and bent at a 90-degree: again other lengths and angles would work equally well.

The present invention contemplates a support device for other sized beds including futons of all sizes, and traditional mattress and box spring sets for standard, twin, King, California King sizes, for example. Changes would include the quantity, size, length and diameter of the straight segments. A king-size mattress, for example, would require an additional 18"-long straight segment with an insert as compared with the queen-sized assembly. A twin assembly, on the other hand, would allow for smaller-diameter and shorter tubing sections and corner segments.

One advantage of the present invention is its ability to fold into a compact shape when not in use as a support for bed covers. For example, a queen sized support frame consisting of seven straight segments, four corner segments and insert members between each adjacent segment, measures about 84-inches long by about 24-inches tall—yet, when disassembled, the various components which are still retained in relative position with respect to adjacent components by means of the elastic member, compacts down to an approximately 21-inch wide, by 5-inch wide by ¼-inch high size. This compact size enables users to store the device 10 when not in use, and further presents a small package for shipping, traveling and for in-store display purposes, for example. When in the compact or folded position, additional hook-and-loop-style fastener straps, such as Velcro-brand One-Wrap 8" cable ties available at any authorized Velcro distributor (see http://www.velcro.com/index.php?page=authorized-distributors) encircle the disassembled frame to keep it in its compact shape. The straps are useful because the elastic member is in constant tension and has a tendency to contract and self-assemble the frame into the cover-support shape, and the straps can be re-used over and over throughout the life of the product.

One method of pre-assembly, that is assembly not performed by the end user prior to each use, but rather a one-time assembly to arrange the components in order so that subsequent uses do not require arranging the components, includes measuring an about 108-inch length of ⅛-inch diameter shock cord (or similar elastic retaining member) and cutting that length from the spool of cord. Next, tie one end of the cut shock cord 16 to one about 0.433" diameter end tip dome cap 12 using a one-half hitch knot and trimming any excess tails from the knot end. The knot is maintained by fusing the end of the cord sheath with heat, for example, from a small open flame or heat gun.

Another step includes sub-assembling the insert members 22 to the appropriate segment 20: For example, the four corner segments 46, 48, 50, and 52 each include a corresponding insert member at the segment's first and second end. The insert member has an outer diameter of 0.433", for example, while the mating segment 20 has an inner diameter of 0.438", for example—which enables a snug fit that can be released or disassembled. However, to prevent unwanted disassembly of the insert member 22 to the appropriate segment 20, an adhesive epoxy, such as Loctite brand from the Henkel Corporation of Avon, Ohio, is applied to bond the insert to the segment. Accordingly, corner segment 46 is bonded to insert member 58 at one end and 60 at the opposite end and so on for each corner. Similarly, the horizontal support frame straight segment 38 is sub assembled with insert members 66 and 68, again using the adhesive to bond the inserts to the appropriate first and second open ends (33 and 35) of the segment 38.

Next, slide each component in sequence over the cord: Thus, the first straight segment 32 arranges adjacent to the cap 12, followed by the first corner segment 46 having an insert member 58 pre-assembled there to, followed by the second straight segment, the second corner segment, the third straight segment and so on around (as FIG. 3 illustrates) until the final straight segment 44 is arranged on the cord 16.

Once all the segments are arranged over the cord 16 in the proper order the second cap 14 is tied to the second end of the cord and fused with heat, as previously explained in relation to the first cap 12.

Although the preferred embodiments of the present invention contemplate aluminum as the material of choice, other materials would work including carbon fiber, fiberglass, various polymers, steel, stainless-steel, brass, other alloys of metal, and so on.

Although the invention has been particularly shown and described with reference to certain embodiments, it will be understood by those skilled in the art that various changes in form and detail may be made without departing from the spirit and scope of the invention.

I claim:

1. A method for supporting a bed cover on a bed having a mattress, the method comprising:

providing a support frame having at least one straight segment coupled to at least one intermediate insert member and at least one corner member and an elastic cord member coupled to the support frame and arranged within an interior portion of each respective at least one straight segment, corner segment and insert member, the support frame further comprising a first leg frame coupled to a horizontal support frame coupled to a second leg frame, the first and second leg frame comprising a horizontal foot and a vertical member connected to the horizontal foot;

assembling the support frame;

inserting the horizontal foot of the first leg frame under the mattress and rotating the horizontal foot of the first leg frame inward in a plane perpendicular to the vertical axis of the vertical member so that the horizontal foot and the horizontal support frame are not parallel in the vertical plane;

inserting the horizontal foot of the second leg frame under the mattress and rotating the horizontal foot of the second leg frame inward in a plane perpendicular to the vertical axis of the vertical member so that the horizontal foot and the horizontal support frame are not parallel in the vertical plane; and arranging the horizontal support frame between the first and second leg frames and disposing the horizontal support frame generally in line with a short axis of the mattress.

* * * * *